United States Patent [19]

Snyder

[11] 4,218,666

[45] Aug. 19, 1980

[54] DUAL MODE BAND REJECTION FILTER

[75] Inventor: Richard V. Snyder, Ringwood, N.J.

[73] Assignee: Premier Microwave Corporation, Port Chester, N.Y.

[21] Appl. No.: 33,877

[22] Filed: Apr. 27, 1979

[51] Int. Cl.[2] ..... H01P 7/06; H01P 1/16; H01D 1/20

[52] U.S. Cl. ..... 333/211; 333/208

[58] Field of Search ..... 333/208, 209, 210, 211, 333/212

[56] References Cited

U.S. PATENT DOCUMENTS 3,697,898 10/1972 Blachier ..... 333/209

*Primary Examiner*—Alfred E. Smith

*Assistant Examiner*—Thomas P. O'Hare

[57] ABSTRACT

A dual mode band rejection filter for attenuating electromagnetic energy in a predetermined stop band having at least one resonant cavity with a pair of orthogonally related modes of propagation. The energy is propagated through a waveguide coupled to ports in the cavity. The waveguide has an input section coupled to a first cavity port, an intermediate section coupled between the first and second ports of the cavity and an output section coupled to the second port. The length of the intermediate section provides a predetermined phase shift between the first and second ports. The filter may include another dual mode resonant cavity coupled to the waveguide by additional waveguide sections.

18 Claims, 12 Drawing Figures

DUAL MODE BAND REJECTION FILTER

BACKGROUND OF THE INVENTION

A. Field of the Invention

This invention relates to the field of art of band reject microwave filters.

B. Prior Art

Microwave band rejection filters have been generally defined as combinations of resonant and antiresonant circuits connected to transmission lines or waveguides so that an undesired band of frequencies is selectively attenuated from the total frequency spectrum. In the case of waveguide filters, the resonant circuits take the physical form of resonant cavities which are coupled to the guide by means of an iris in the wall of the guide. The specific cross-sectional shape of the iris (round, square, rectangular, etc.) permits certain propagation modes of R-F energy to pass from the guide into the cavity thereby providing the excitation energy sufficient to propagate various modes within the cavity. The irises associated with a given cavity are situated in odd multiple of $\lambda_{g/4}$ where $\lambda_g$ refers to the main guide wavelength. Quarter wavelength iris spacing results in an energy loss or attenuation over a desired spectral range due to properly phased wave cancellation caused by the resonant behavior of the cavities.

The amount of attenuation of waveguide energy at any given frequency is determined by the shape and positioning of the coupling iris, the dimension and form of the cavity and the number of cavities employed in a given band rejection filter configuration. Attenuation characteristics may be predicted by utilizing lumped element prototype filter models which are well known in the art of conventional network synthesis techniques.

Coupled propagation modes may coexist at certain points within the cavity volume and have a real Poynting's vector existing at such points for a given pair of modes. Power contained in the spectral lines will be transferred between such modes on a known basis at a given point within the cavity. Such coupling is the equivalent behavior of an iris located between two single mode cavities thereby allowing energy flow between the two cavities. Uncoupled modes have no transfer of power from one mode to another mode within the cavity. In the uncoupled case, the electric and magnetic fields are orthogonal at all points within the cavity. In the coupled case, the fields are forced to be nonorthogonal at a known point on the cavity wall.

Band reject waveguide filters that provide microwave band reject filtering have in the past used rectangular or cylindrical cavities spatially situated along a straight section of waveguide in which each cavity has supported a single mode of propagation. The irises associated with each such cavity have been located at a distance of $(2N-1)\lambda_{g/4}$ apart, along the length of a straight waveguide section. However, such configurations in the prior art have had the disadvantage of large physical size, physical complexity and high fabrication costs.

Accordingly, an object of the present invention is to introduce a new class of band reject filters which utilize dual mode propagation behavior as the principal filtering technique and providing simplicity and compactness.

SUMMARY OF THE INVENTION

A dual mode band rejection filter for attenuating electromagnetic energy in a desired stop band having at least one resonant cavity with a pair of modes of propagation. The cavity has a first and a second port for transfer of energy into and out of the cavity. Transmission means is coupled to the first and second ports and includes an input section coupled to the first port, an intermediate section coupled between the first and second port and an output section coupled to the second port. The length of the intermediate section provides a predetermined phase shift between the first and second ports.

DETAILED DESCRIPTION

Figure 1:
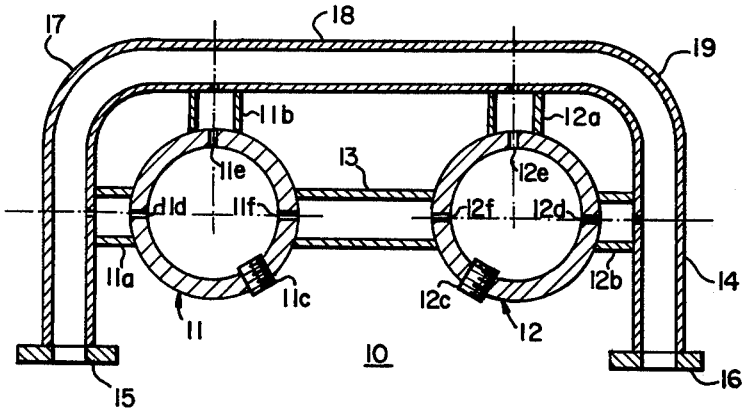
FIG. 1 is a sectional view of a two cavity dual mode band reject filter embodying the invention.

Referring to FIG. 1, there is shown a generalized dual mode band reject microwave filter 10 comprised of mainline waveguide 14 with energy excitation provided at input manifold 15. R-F energy travels along section 17 past input/output (I/O) ports 11*a* and 11*b* of cavity 11, through section 18 and past ports 12*a* and 12*b* of cavity 12 and finally exiting filter 10 at output manifold 16. Cavities 11 and 12 contain splitting screws 11*c* and 12*c* respectively and the cavities 11 and 12 are interconnected by waveguide 13.

It will be understood that energy in cavity 11 passes through irises 11*d*, 11*e* and 11*f* and energy in cavity 12 passes through irises 12*d*, 12*e* and 12*f*. Depending upon the spatial orientation of coupling iris 11*f* and 12*f*, either of the two resonant modes in cavity 11 can be coupled to either of the two resonant modes in cavity 12 providing that the phase shift through the connecting guide 13 is not equal to 90°. Thus the modes are coupled internal to the cavity structures by way of waveguide 13 and external to the cavities by way of waveguide sections 17–19. This approach permits independent control and relocation of the passband zeros or the stop band poles of the filter transfer function. Independent adjustment of the amplitude and phase characteristics of filter 10 is thus possible. Waveguide sections 17, 18 and 19 are adjusted for quadrature or nonquadrature phase shift.

The dual mode of propagation operative in filter 10 using square cross-section waveguide is $TE_{10N}$. The dual modes in cavities 11 and 12 originate through the action of the I/O ports 11*a*, 11*b*, 12*a* and 12*b* and are influenced by the action of splitting screws 11*c* and 12*c*. I/O ports 11*a* and 11*b* function independently of each other and without influence, to first order, of the other input/output port within a given cavity. In so doing, the natural cavity mode is excited from each I/O port. The independently excited mode patterns are identical in all respects but are rotated 90°. These mode patterns cross each other at every point within cavities 11 and 12 and coexist with 90° phase separation. Therefore, the cross product of the E field and the H field is always zero such that the coexistent modes do not couple to one another. In other words, the Poynting's vector, a function of the electric E field and magnetic H field, is equal to zero at all points within cavities 11 and 12. No power transfer occurs between the pair of coexistant modes. To meet this requirement, it is required that the respective field lines of each mode be orthogonal. This condition can only be satisfied by several modes and specifically, the $TE_{11N}$ modes in cylindrical guides, and the $TE_{10N}$ modes in square guides, where N is the cavity length expressed in half wavelengths. The higher N numbers provide the advantage of higher Q factors yet suffer from the closer proximity of spurious modes.

Figure 2:
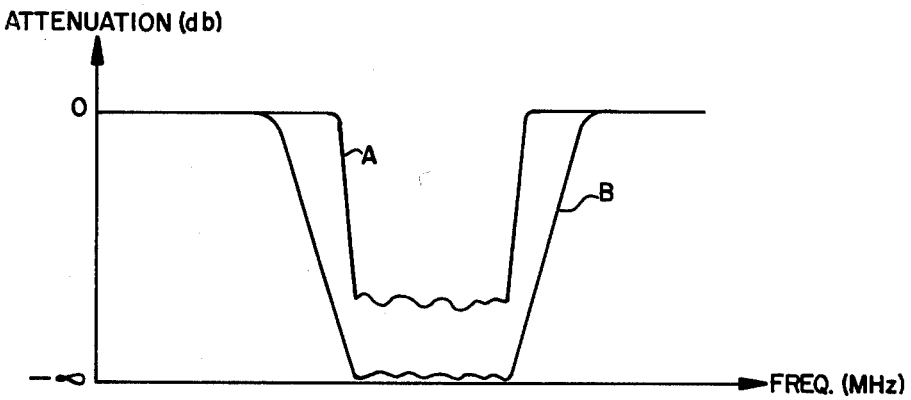
FIG. 2 illustrates generalized performance characteristics of attentuation vs. frequency.

The attenuation characteristic provided by the generalized dual mode band reject filter 10 is shown by curve A in FIG. 2. The behavior of this nonminium phase elliptic response offers less attenuation in the stop band region when contrasted to the minimum phase response characteristic shown by curve B in FIG. 2. However, improved selectivity can be realized with a filter of the nonminimum elliptic type due to the sharper slope of the skirts of the attenuation characteristic upon entering and leaving the stop band region.

Figure 3A:
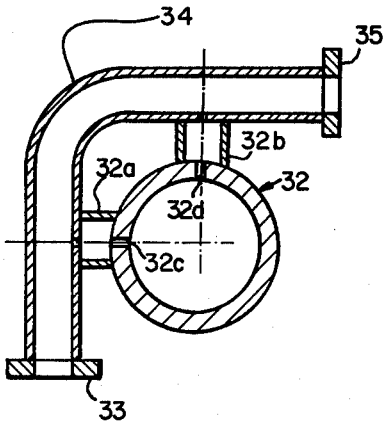
FIGS. 3A–C are sectional views of other embodiments of the invention showing a single cavity dual mode band rejection filter.

Another embodiment of the invention is shown in FIG. 3A which shows an uncoupled dual mode band reject filter 20 of the minimum phase type. The single cavity filter 20 is comprised of waveguide 31, cylindrical cavity 32, and input/output ports 32*a* and 32*b*. Input R-F energy enters the filter at input manifold 33, excites the cavity at I/O ports 32*a* and 32*b* by way of a quadrature phase shift section 34 and finally exits at output manifold 35. The spectrum of the departing R-F energy has attenuated frequency components across the region of the stop band as shown by the attenuation characteristic of curve A, FiG. 2. The single cavity filter 20 permits the attainment of a two-pole response transfer function.

Pairs of uncoupled orthogonal propagation modes exist within cavity 32 with dual $TE_{10N}$ or TM modes being dominant. Mode coupling is achieved by means of section 34 of waveguide 31. The length of section 34 is determined by relation 1 later described in detail with respect to the two-cavity filter shown in FIG. 4. Undesired cavity eccentricity causes unwanted mode coupling within cavity 32 region thereby generating zeros in the filter transfer function with subsequent limiting of the attenuation depth in the region of the stop band. Susceptive loading effects of irises 32*c* and 32*d* reduce the required length of guide coupling section 34. As understood by those skilled in the art the guide length of section 34 can be adjusted by employment of dielectric constants, tuning screws or reduced waveguide cross-sectional area in section 34.

Figure 3B:
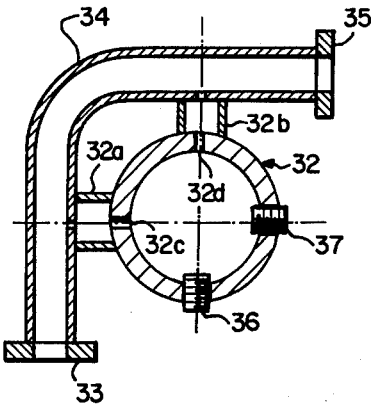
Figure 3C:
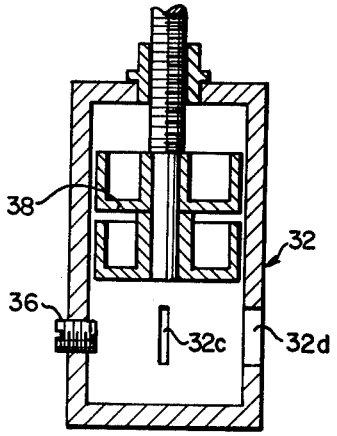

FIG. 3B shows a similar dual mode band reject filter 20*a* (uncoupled mode) but provided with tracking screws 36 and 37 provided to achieve stop band tuning along the frequency axis. FIG. 3C shows a cross-section of cavity 32 of filter 20*a* with an adjustable dual section plunger 38 used for varying the size of the cavity providing variability of the filter pole and zero location points.

Figure 4:
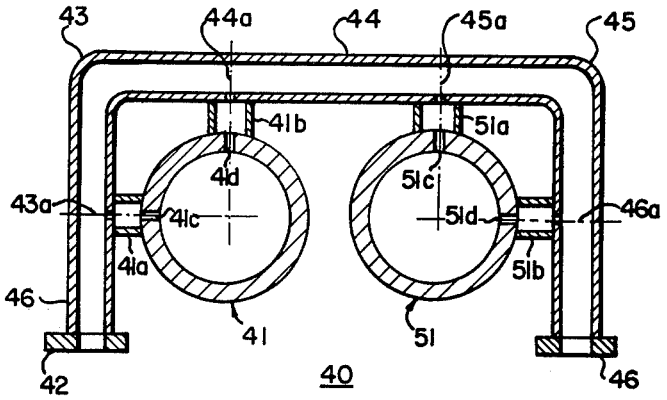
FIGS. 4 and 5 are sectional views of a further embodiment of the invention showing a two cavity dual mode band reject filter.

Referring now to FIG. 4, there is shown a further embodiment of the invention in which a two-cavity waveguide filter 40 is comprised of cylindrical cavities 41 and 51. This configuration yields a minimum phase design in which dual mode cavities are used with the orthogonal modes intentionally uncoupled within the cavity. Cavities 41 and 51 each support a $TE_{11N}$ dominant mode of propagation. Alternately, a $TM_{11N}$ mode of propagation could be employed. Incoming microwave energy to the rectangular cross-section waveguide 46 enters the guide at input manifold 42, propagates past cavity I/O ports 41*a*, 41*b*, 51*a* and 51*b* and exits at output manifold 46. The design principle underlying the formation of band reject filter 40 is based on utilization of pairs of uncoupled orthogonal propagation modes within each of the cavities 41 and 51. Mode coupling is achieved by way of the interconnecting guide sections 43, 44 and 45. The physical length of these sections is given by the relation $(2N-1)\lambda_{g/4}$ yielding quadrature phase (90°) shift at the band rejection center frequency between points 43*a*, to 44*a*, 44*a* to 45*a* and from 45*a* to 46*a*. Mode coupling by way of the path of the interconnecting guide section 44 between cavities 41 and 51 achieves an identical function as performed by the interconnecting sections 34 between ports 32*a* and 32*b* of the single cavity filter structure 20 shown in FIG. 3A.

The interconnection guide sections 43, 44 and 45 from centerline 43*a* of port 41*a* to 44*a* of port 41*b*, from 44*a* of port 41*b* to 45*a* of port 51*a* and 45*a* of port 51*a* to 46*a* of port 51*b* are respectively adjusted to the correct phase length by the utilization of various means such as dielectric inserts, tuning screws forming a pass band filter network or other known means for increasing the effective phase length between cavity I/O ports 41*a*, 41*b*, 51*a* and 51*b*.

Eccentricity from true cross-section circularity will produce undesired mode coupling within cavities 41 and 51. The effect of this coupling is to introduce undesired pairs of transmission zeros in the filter transfer function throughout the region of the filter stop band. The net physical effect is the limitation of the amount of attenuation introduced by a given cavity across the entire stop band region of the filter. Therefore, unwanted mode coupling results in limitation of the stop band attenuation depth, alternately expressed, degradation of the skirt slope $DB/\Delta\omega$ of the filters attenuation characteristic in the stop band. However, with proper and careful construction, sidewall coupled dual mode filters have been demonstrated to be virtually indistinguishable from single mode designs down to attentuation levels in the vicinity of 80 DB.

In filter 40 the interconnecting length of waveguide 43 between cavity I/O ports 41*a* and 41*b* is determined from the following relation.

$$L_{43AV}=(2N-1)\lambda_{g/4} \quad (1)$$

where $\lambda_g$ is the wave length of interconnective waveguide 43 and N=1,2,3,4.

If cavities 41 and 51 utilize the $TE_{111}$ mode $F_O-10$ GHz and using waveguide type WR-90 the required interconnecting length $L_{43AV}$ can be calculated (using N=2) to be equal to 1.172 inches. The minimum quadrature phase length can be calculated using the following relation.

$$\text{Minimum } L_{AV}=\pi D/4 \quad (2)$$

where D is the diameter of the cylindrical cavity.

Using relation 2 and a D value of 1.00 inches, the minimum $L_{AV}$ can be calculated to be 0.786 inches. It is seen that additional phase length is required to satisfy relation 1. The additional phase length is obtained by shaping the waveguide as shown in FIG. 4 as contrasted to the concentric shape (relative to the cavity) of waveguide 34 shown in FIG. 3A. Thus by proper forming of the guide, its length can be increased from 0.786 inches to 1.172 inches as required.

Figure 5:
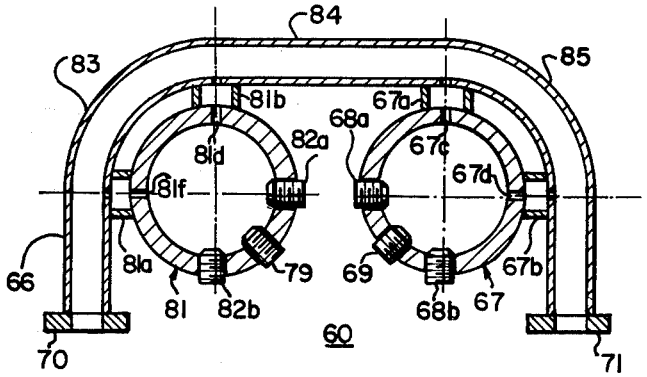
Figure 6:
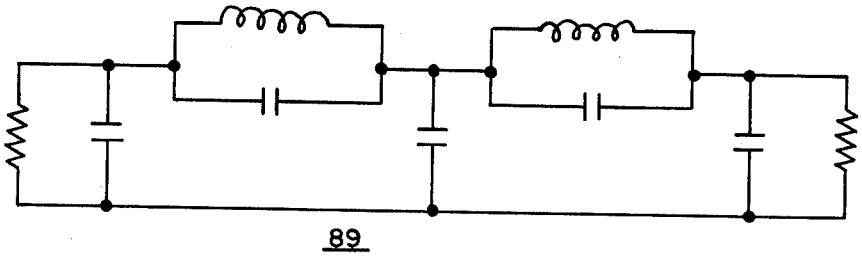
FIG. 6 is a schematic diagram of a conventional low pass elliptic prototype using lumped elements upon which is based the band reject filter of FIG. 5.

Referring to FIG. 5 there is shown a still further embodiment of the invention in the form of a filter 60 which utilizes an elliptic coupled dual mode technique. Filter 60 is based on a conventional low pass elliptic prototype structure 89 shown in FIG. 6 and is comprised of waveguide structure 66 which receives incoming R-F energy at input manifold 70. This energy excites cavity 81 by way of I/O ports 81*a* and 81*b* and additionally excites cavity 67 by way of I/O ports 67*a* and 67*b*. The three waveguide sections 83–85 are adjusted in length according to relation 1 such that the quadrature phase relationships exist between ports 81*a* and 81*b*, ports 81*b* and 67*a*, and between ports 67*a* and 67*b*. The phase difference from the centerline of port 81*a* and the centerline of port 67*b* is 270°.

Cavity 81 has two tracking screws 82*a–b* and cavity 67 has two tracking screws 68*a–b*. These tracking screws are located diametrically opposite irises 81*c–d*, 67*c–d*, associated with each respective I/O port. The function of tracking screws 82*a–b*, 68*a–b*, enables the resonant frequencies of these modes to be tuned synchronously thereby permitting shifting of the central location of the stop band while maintaining the desired relationship between stop band and pass band. The susceptance of these screws affects, to first degree, only the mode coupled into the iris opposite each respective screw. It has been found that, in order to achieve maximum orthogonality, the physical shape of the tracking screws 82*a*, 82*b*, 68*a* and 68*b* should be machined such that the screw cross-section conforms to the shape of the opposite iris. Hence, if the coupling iris is rectangular, the tracking screw is also made rectangular rather than round as in prior structure. To accomplish movement the screw becomes a plunger of rectangular cross-section and means are provided to drive the plunger in and out of the cavity.

Figure 7:
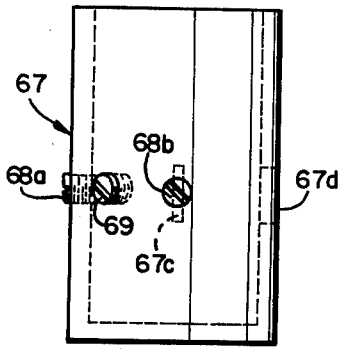
FIG. 7 is a side view of cavity 67 shown in FIG. 5.

The mode coupling screws 69 and 79 associated with cavities 67 and 81 respectively permit adjustment of the Q factors associated with each pair of transmission zeros contained in the transfer function of this elliptic band reject filter. FIG. 7 shows a side view of cavity 67 of FIG. 5 so that the rectangular cross-section of iris 67*a* associated with I/O port 67*a* may be seen.

The elliptic dual cavity band reject filter operating in the coupled dual mode is synchronously tunable over a reasonably wide bandwidth while maintaining an approximately constant percentage bandwidth. To achieve wide band tuning characteristics the connecting waveguide sections 83–85, FIG. 5 should be adjustable. Alternately, attenuation degradation due to improper phase addition of the operative modes within the resonant cavities must either be tolerated or compensated in some way. Such compensation is realizable to a small degree by using an iris configuration that is frequency sensitive. Computations and measurements both indicate that a change in the center frequency of the rejection band of +/−8% coupled with an instantaneous bandwidth deviation of less than +/−1% does not significantly contribute to degradation on the skirt characteristics of the attenuation function.

Furthermore, the iris and screw coupling coefficients for sidewall cavities may be derived by using the formulation set forth in R. V. Snyder, "The Dual Mode Filter—a Realization," *Microwave Journal*, Dec. 1974. It has been found that the location points for irises 81*c–d*, 67*c–d*, FIG. 5 may be determined which will achieve a minimum coupling coefficient as the center frequency of the stop band is varied. If the longitudinal length of the cavity is given the distance L, the input iris 81*c* should be centered approximatly 0.67 L from the fixed end of the cavity, viz, base 73 of the cavity, FIG. 7. In addition, the center of iris 67*a* should be located at a distance from the fixed end of approximately 0.63 L. Screws 82*a–b* and 79 are located in positions between these values. It will be understood that gang tuning can be accomplished by using the type of gear coupling shown in FIG. 1 of U.S. Pat. No. 3,936,775.

Figure 8:
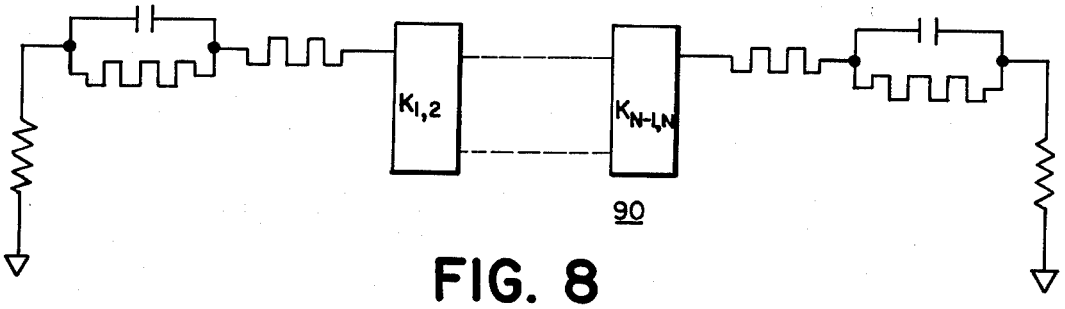
FIG. 8 is a schematic diagram of an elliptic prototype using lumped elements upon which is based a still further embodiment of the invention having a physical form similar to that of FIG. 4.

A still further embodiment of the invention may have a physical form similar to that of FIG. 4 with an important difference with respect to dimensioning of the coupling lengths of waveguide sections 43–45. Such embodiment would be based on the Rhodes "Natural" elliptic prototype structure 90 shown in FIG. 8. Using filter structure 90 and a design prototyping model, a stop band filter may be designed in which uncoupled dual modes are utilized in a manner similar to the minimum phase design previously described with respect to FIG. 4. Network synthesis for the uncoupled dual mode elliptic design is described in J. D. Rhodes, "Waveguide Bandstop Elliptic Function Filter," TRANS. MTT-20, Nov. 1972. Coupling and interconnection details for this filter follow the design principles of the minimum phase design with the important exception that the phase relationship of the center frequency of the filter stop band is no longer quadrature between points 43*a*–44*a*, 44*a*–45*a* and 45*a*–46*a*. Sections 43–45 are adjusted in size for a phase length unequal to 90°. Mode coupling is accomplished by way of the interconnecting waveguide sections 43–45 and the associated I/O ports 41*a–b*, 51*a–b*.

Figure 9:
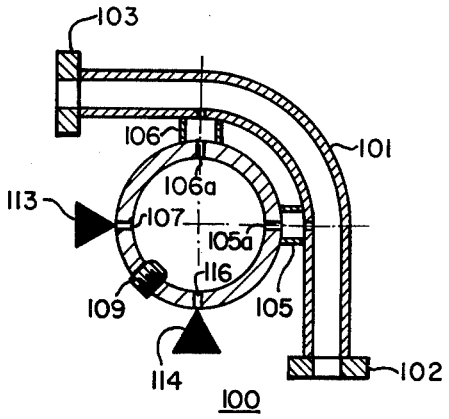
FIG. 9 is a sectional view of a still further embodiment of a single cavity dual mode band reject filter providing a nonreflective stop band response.

An additional embodiment of the invention is shown in FIG. 9 as an absorptive dual mode rejection filter 100. Filter 100 (a filter of this type can provide a nonreflective stop band response) is comprised of a transmission waveguide 101 with energy entering at input manifold 102 and exiting at output manifold 103. Dual modes are excited by irises 105*a* and 106*a* located in I/O ports 105, 106 respectively within cavity 108. Splitting screw 109 is provided to achieve mode coupling of the nonminimum elliptic realization. Output ports 107 and 110 are provided in the wall of the cavity through which energy can be transferred into absorptive loads 113 and 114 respectively. Each mode within dual mode cavity 108 is provided with an assigned exit port which through the action of irises 115 and 116 permit the flow of mode energy to respective absorptive loads 113 and 114, viz, Mode 1 to load 113 and Mode 2 to load 114.

Figure 10:
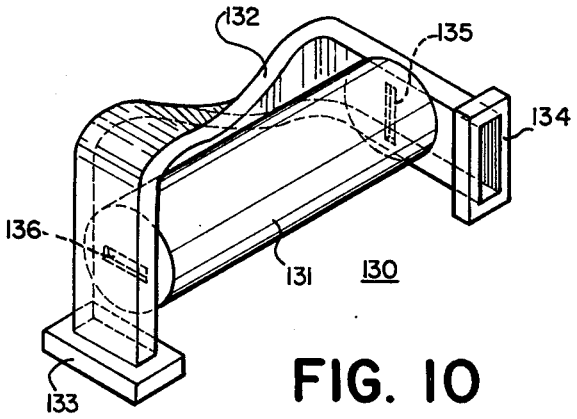
FIG. 10 is a perspective view of an additional embodiment of the invention showing a single cavity dual mode band reject filter having ports disposed on the end walls of the cavity.

The final embodiment of the dual mode rejection filter is shown in FIG. 10. This configuration comprises a rectangular waveguide 132 through which R-F energy enters at input manifold 133. The R-F energy exits cyclindrical cavity 131 at I/O port 136 and in addition, continues through waveguide 132 which undergoes a 90° physical twist as shown. R-F energy is coupled into the opposite wall of cavity and I/O port 135 and then exits the filter section at output manifold 134. The iris of port 135 is oriented physically orthogonal with respect to the iris of I/O port 136. This orientation provides the cavity boundary conditions necessary to sustain dual TE mode coupling action within cavity 131.

What is claimed is:

1. A dual mode band reject filter comprising at least one resonant cavity having a pair of modes of propagation, said cavity having first and second ports for transfer of energy into and out of said cavity, and transmission means coupled to said first and second ports including an input section coupled to said first port, an intermediate section coupled between said first and second ports and an output section coupled to said second port, the length of said intermediate section providing a predetermined phase shift between said first and second ports.

2. The dual mode band reject filter of claim 1 in which said intermediate section of said transmission means is of length to provide nonquadrature phase shift.

3. The dual mode band reject filter of claim 1 in which said intermediate section of said transmission means is of length to provide quadrature phase shift.

4. The dual mode band reject filter of claim 1 in which there is provided an additional resonant cavity having first and second ports, said output section additionally being coupled to said first port of said additional cavity, said transmission means having (1) an additional intermediate section coupled between said additional cavity first and second ports and (2) an additional output section coupled to said additional cavity second port, the length of said additional intermediate section providing a predetermined phase shift between said additional cavity first and second ports.

5. The dual mode band reject filter in claim 4 in which each of said cavities has an additional port, means connected to said additional ports for coupling the resonant modes in both of said cavities.

6. The dual mode band reject filter of claims 1 or 4 in which there is provided load means coupled to a cavity for dissipating resonant energy.

7. The dual mode band reject filter of claims 1, 2, 3 or 4 in which each of said cavities is a cylindrical cavity and the ports are disposed on the sidewalls of each cylindrical cavity.

8. The dual mode band reject filter of claim 1 in which the cavity is a cylindrical cavity having ports disposed on the end walls of the cylindrical cavity, said transmission means comprises a waveguide twisted to provide a quadrature phase shift.

9. The dual mode band reject filter for attenuating electromagnetic energy in a desired stop band comprising at least one resonant cavity having a pair of orthogonally related modes of propagation, said cavity having a first and a second port for transfer of energy into and out of said cavity, and waveguide means having said energy propagated therethrough and coupled to said first and second ports, said waveguide means including a first section coupled to said first port, a second section coupled between said first and second ports and a third section coupled to said second port, the length of said second section providing a predetermined phase shift from said first port with respect to said second port whereby the resonant energy within said cavity is attenuated from the energy being propagated through the transmission means.

10. The dual mode band reject filter of claim 9 in which said second section of said waveguide means provides quadrature phase shift.

11. The dual mode band reject filter of claim 9 in which said second section of said waveguide means provides nonquadrature phase shift.

12. The dual mode band reject filter of claim 9 in which there is provided an additional resonant cavity having third and fourth ports, said waveguide means third section coupled to said third port, said waveguide means having a fourth section coupled to said third and fourth ports and a fifth section coupled to said fourth port, the length of said fourth section providing a predetermined phase shift between said third and fourth ports of said additional cavity.

13. The dual mode band reject filter of claim 12 in which the second, third and fourth sections of said waveguide means are of length to provide quadrature phase shift.

14. The dual mode band reject filter of claim 12 in which the second, third and fourth sections of said waveguide means are of length to provide nonquadrature phase shift.

15. The dual mode band reject filter of claims 12 or 14 in which each of said cavities has an additional port, means connected to said additional ports for coupling the resonant modes in both of said cavities.

16. The dual mode band reject filter of claims 9 or 12 in which there is provided load means coupled to a cavity for dissipating resonant energy.

17. The dual mode band reject filter of claims 9, 10, 11 or 12 in which each of said cavities is a cylindrical cavity and said ports are disposed on the sidewalls of the cylindrical cavity.

18. The dual mode band reject filter of claim 9 in which the cavity is a cylindrical cavity having said ports disposed on the end walls of the cylindrical cavity, said waveguide means being twisted to provide a quadrature phase shift.

* * * * *